US009726427B1

(12) United States Patent
Narinsky

(10) Patent No.: US 9,726,427 B1
(45) Date of Patent: Aug. 8, 2017

(54) LIQUID NITROGEN PRODUCTION

(75) Inventor: George B. Narinsky, Boston, MA (US)

(73) Assignee: Cosmodyne, LLC, Seal Beach, CA (US)

( * ) Notice: Subject to any disclaimer, the term of this patent is extended or adjusted under 35 U.S.C. 154(b) by 1049 days.

(21) Appl. No.: 12/800,637

(22) Filed: May 19, 2010

(51) Int. Cl.
*F25J 3/00* (2006.01)
*F25J 3/04* (2006.01)

(52) U.S. Cl.
CPC ..... *F25J 3/04024* (2013.01); *F25J 3/0423* (2013.01); *F25J 3/04109* (2013.01); *F25J 3/04157* (2013.01); *F25J 3/04181* (2013.01); *F25J 3/04187* (2013.01); *F25J 3/04454* (2013.01); *F25J 3/04884* (2013.01); *F25J 2200/08* (2013.01); *F25J 2200/74* (2013.01); *F25J 2205/70* (2013.01); *F25J 2210/40* (2013.01); *F25J 2215/42* (2013.01); *F25J 2215/44* (2013.01); *F25J 2230/30* (2013.01); *F25J 2240/10* (2013.01); *F25J 2250/02* (2013.01)

(58) Field of Classification Search
CPC .. F25J 3/04018; F25J 3/04024; F25J 3/04109; F25J 3/04187; F25J 3/04436; F25J 3/04448; F25J 2200/08; F25J 3/04454; F25J 2200/50; F25J 2200/72; F25J 2200/74; F25J 2200/78; F25J 2210/06; F25J 2230/24; F25J 2240/10
USPC ..... 62/640, 643, 646, 647
See application file for complete search history.

(56) References Cited

U.S. PATENT DOCUMENTS

| | | | | | |
|---|---|---|---|---|---|
| 3,676,304 | A * | 7/1972 | Hobbs et al. | 202/160 |
| 3,736,762 | A | 6/1973 | Toyama et al. | |
| 4,152,130 | A | 5/1979 | Theobald | |
| 4,375,367 | A | 3/1983 | Prenticd | |
| 4,662,917 | A * | 5/1987 | Cormier et al. | 62/646 |
| 4,705,548 | A * | 11/1987 | Agrawal et al. | 62/645 |
| 4,715,873 | A * | 12/1987 | Auvil et al. | 62/646 |
| 5,069,699 | A * | 12/1991 | Agrawal | 62/646 |
| 5,245,832 | A * | 9/1993 | Roberts | 62/654 |
| 5,275,003 | A * | 1/1994 | Agrawal et al. | 62/646 |
| 5,331,818 | A * | 7/1994 | Rathbone | 62/646 |
| 5,341,646 | A * | 8/1994 | Agrawal et al. | 62/646 |
| 5,351,492 | A * | 10/1994 | Agrawal | F25J 3/04048 62/648 |
| 5,611,218 | A | 3/1997 | Naumovitz | |
| 5,704,229 | A | 1/1998 | Coakley et al. | |
| 5,934,106 | A | 8/1999 | Mc Poland et al. | |
| 6,141,989 | A * | 11/2000 | Oakey | 62/647 |
| 6,257,019 | B1 * | 7/2001 | Oakey et al. | 62/646 |
| 6,347,534 | B1 * | 2/2002 | Ha | 62/646 |

* cited by examiner

*Primary Examiner* — Keith Raymond
(74) *Attorney, Agent, or Firm* — SoCal IP Law Group LLP; Mark A. Goldstein

(57) ABSTRACT

An improved process for liquid nitrogen production by cryogenic air separation using a distillation column system to enhance the product recovery.

11 Claims, 3 Drawing Sheets

LIQUID NITROGEN PRODUCTION

BACKGROUND OF THE INVENTION

This invention concerns a new and efficient process for producing liquid nitrogen.

Liquid nitrogen is normally produced as a by-product of oxygen production. While there are sizable market demands for nitrogen by itself, in fields such as glass making, chemical inverting, electronics, and food preparation, these are end demands for the gas product, and the liquid form is merely a convenience for transportation and storage.

Large or stand alone demands for nitrogen gas are conventionally supplied by nitrogen gas generators, which often involve cryogenic distillation but produce no meaningful amounts of nitrogen in liquid form. When there is a large demand for the liquid form, without the simultaneous requirement of oxygen, nitrogen gas generators are typically coupled with a separate nitrogen liquefaction unit to fulfill this requirement.

SUMMARY OF THE INVENTION

It is a major object of the invention to provide an improved process for the direct production of liquid nitrogen, for example as a sole product in an integrated process, saving both power and capital. Basically, the improved process is enabled by use of systems containing distillation columns, operating in series at different pressure levels, to extract a higher yield of nitrogen per unit of compressed air feed processed, as will be seen. The process basically includes:

a) passing a portion of pressurized air feed through a cold expander and feeding a part of the air exhaust from said expander as a gaseous air stream into the bottom of a first column having a top condenser, b) passing another portion of the pressurized air feed through the main heat exchanger for cooling and liquefying, passing said portion of air through a valve and feeding as a liquid air stream into the middle of the first column;

c) separating the said gaseous and said liquid air streams in the first column into a first liquid nitrogen stream and a first oxygen-enriched liquid stream;

d) feeding the first oxygen-enriched liquid stream into the middle of a second column having a bottom reboiler, in which the liquid is evaporated due to indirect heat exchange with the nitrogen vapor in the first column top condenser, and a top condenser;

e) separating the first oxygen-enriched liquid stream in the second column into a second liquid nitrogen stream and a second oxygen-enriched liquid stream;

f) feeding the second oxygen-enriched liquid stream into the middle of a third column having a bottom reboiler, in which the liquid is evaporated due to indirect heat exchange with the nitrogen vapor in the second column top condenser, and a top condenser, or into an upper reboiler;

g) separating the second oxygen-enriched liquid stream in the third column into a third liquid nitrogen stream and a third oxygen-enriched liquid stream, and feeding the third oxygen-enriched liquid stream into the upper reboiler;

h) evaporating the oxygen-enriched liquid stream in the upper reboiler due to indirect heat exchange with the nitrogen vapor in the third or second column top condenser;

i) removing the first liquid nitrogen stream from the first column and feeding it into the top of the third or second column;

j) removing the second liquid nitrogen stream from the second column and feeding it into the top of the third column or using it as a liquid nitrogen product;

k) removing the third liquid nitrogen stream from the third column and using it as a liquid nitrogen product;

l) removing the evaporated oxygen-enriched stream from the upper reboiler, warming it and removing from the process.

As will be seen, the cleaned and pressurized air feed is split in two streams, the first stream is passed through a warm expander, the second stream is further compressed in boosters by using expander power, previously cooled in a main heat exchanger and split in two portions, one portion of this air feed is passed through a cold expander and the other portion is further cooled and liquefied in the heat exchanger; using a tripe or double distillation columns system to enhance recovery of liquid nitrogen from air enabling substantial reduction in the feed air compressor, and absorber size and power.

A further object is to provide for use of these multiple distillation column systems to enhance recovery of nitrogen from air, and to permit use of an air recycle process to produce refrigeration. Significant reductions in main heat exchanger size and cost are enabled.

Yet another object is provision of a complete process including provision of distillation columns, condenser-reboilers, heat exchangers and compressors, operating as disclosed herein.

DRAWING DESCRIPTION

Figure 2:
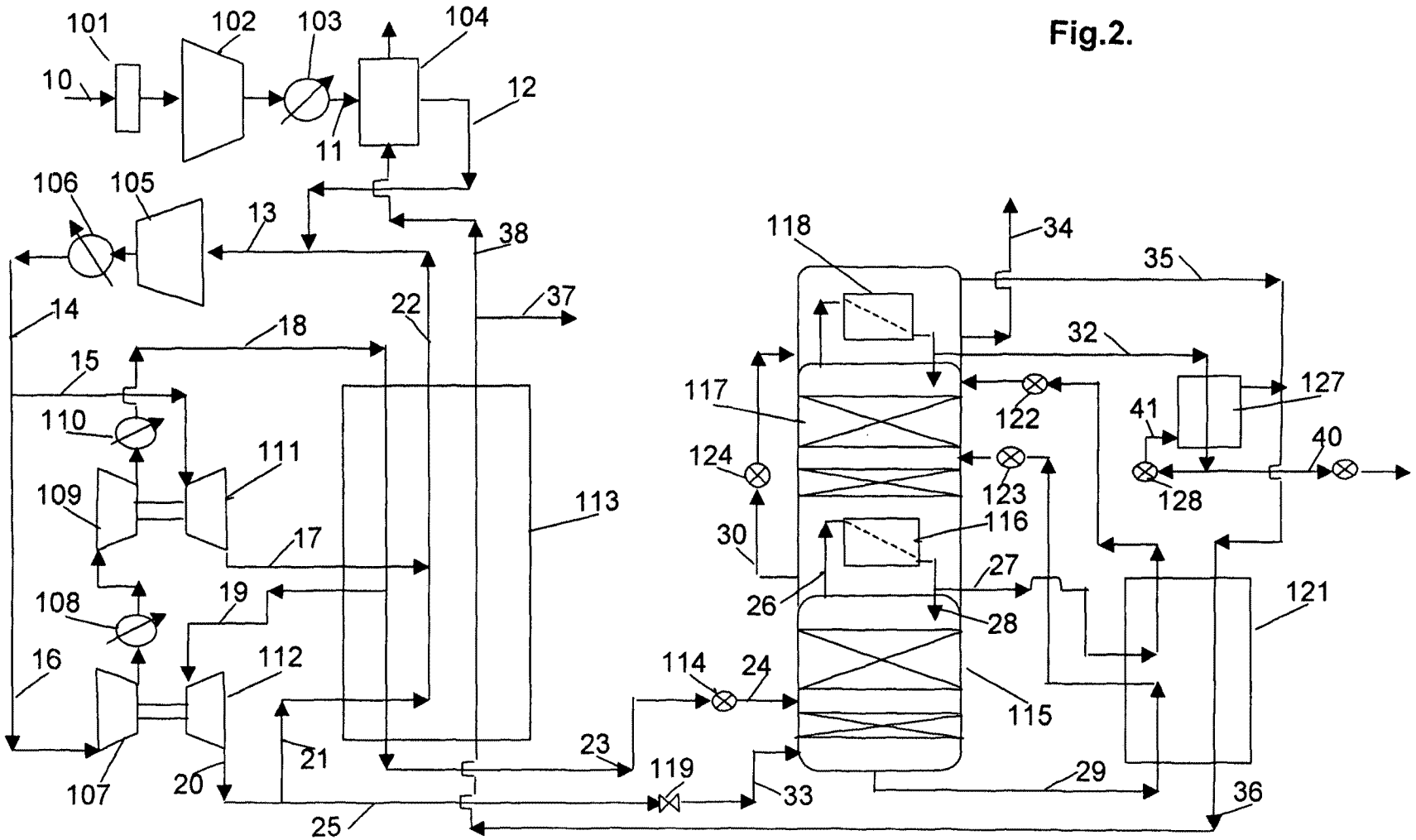
FIG. 2 is a schematic showing a process for producing liquid nitrogen from air with a double distillation column system.
Figure 2A:
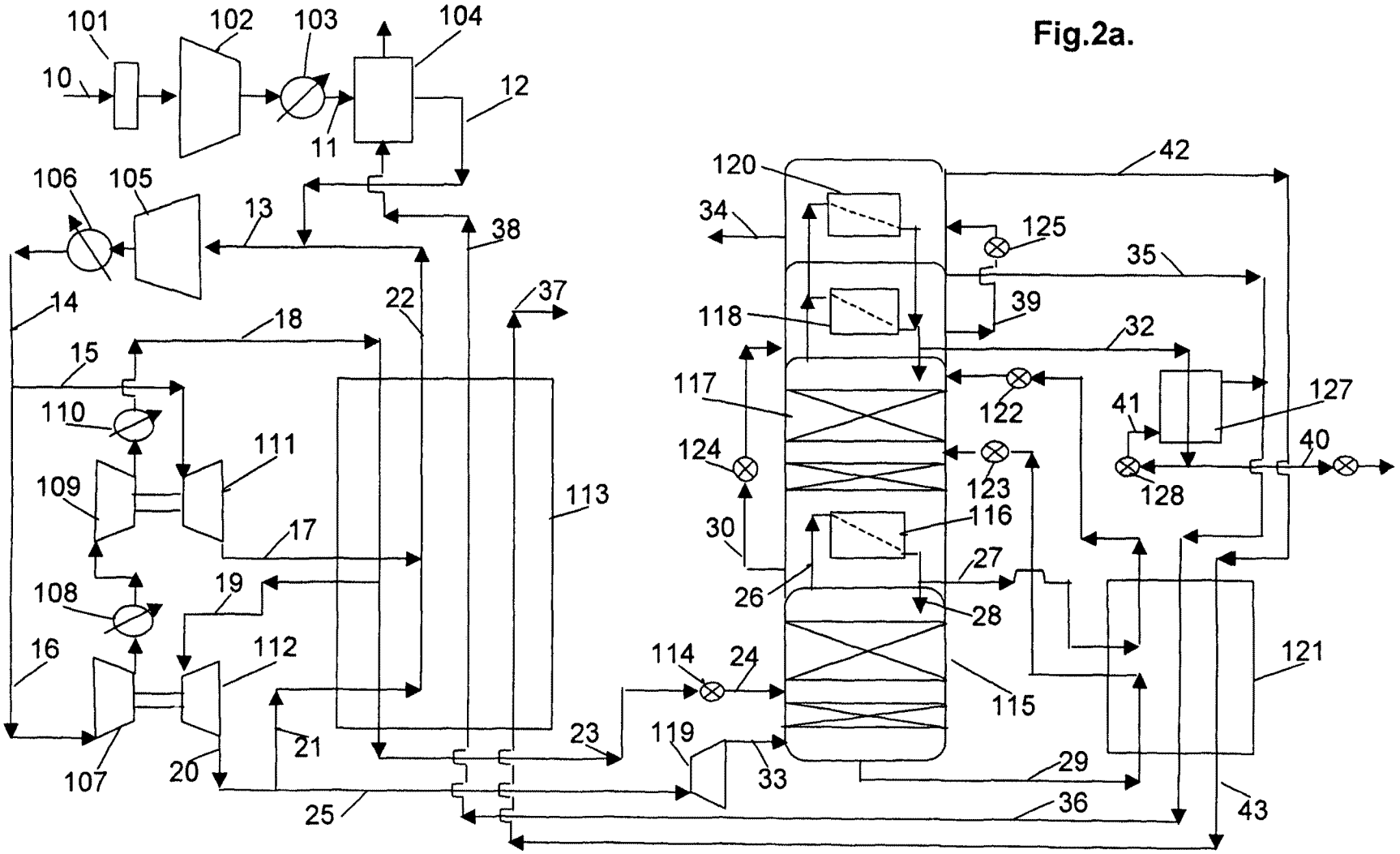

FIG. 2*a* is a schematic with a modified double distillation column system.

DETAILED DESCRIPTION

Figure 1:
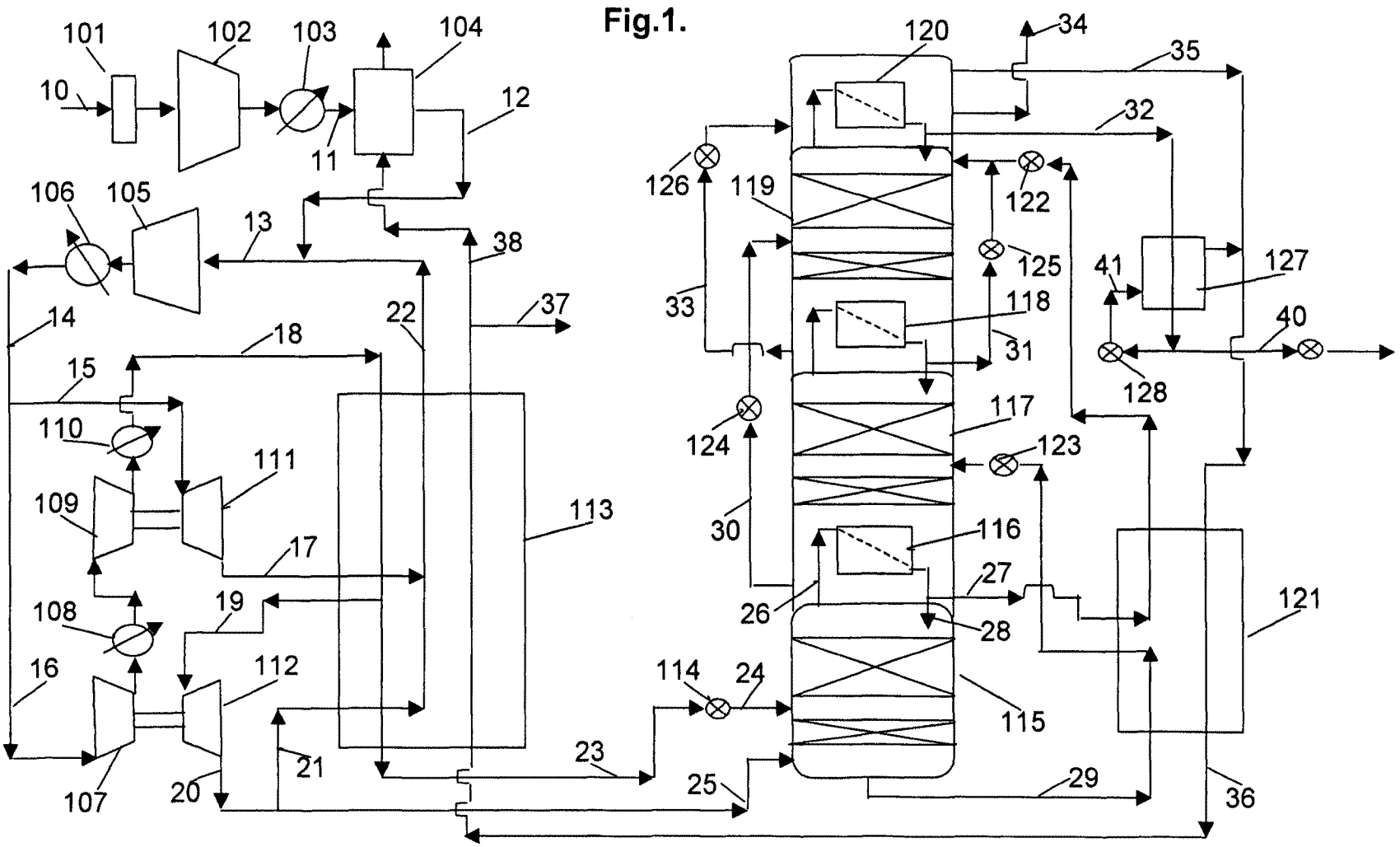
FIG. 1 is a schematic showing of a process for producing liquid nitrogen from air with a triple distillation column system.

Referring to the schematic of FIG. 1, air feed at 10 is filtered in 101, and compressed at 102 to a pressure of 8 to 10 bara, cooled in 103, and after removal in adsorber 104 of water and carbon dioxide, the air is mixed with the recycle stream 22 removed from the main heat exchanger 113 and at 13 fed to the compressor 105, where it is further compressed to about 40 bara (+/−5), and cooled in 106.

A portion 16 (or all) of the compressed air stream 14 is then boosted in one or two compressors 107 and 109, driven by one or two turbo expanders 112 and 111, to a pressure between 70 and 90 bara at 18. The other portion 15 of the compressed air is fed in the warm turbo expander 111 and then to the heat exchanger 113 at 17.

The boosted air is then cooled in the heat exchanger 113, and a portion is fed at 19 to the cold turbo expander 112, the remainder 23 being further cooled and liquefied, then expanded in a valve 114 and fed to the middle of the first distillation column 115 as a liquid air stream.

The exhaust 20 from the cold turbo expander is split. One portion returns at 21 to provide cooling in the aforementioned heat exchanger 113 while the split remainder to fed at 25 into the bottom of the first distillation column 115 as a gaseous air stream. In that first column, operated about from 7.5 to 9 bara, the air is distilled into pure nitrogen (from 1.0 to 0.0001 mol % of $O_2$) at 26, and condensed in the top condenser 116, a portion of the condensate being removed at 27 as a first liquid nitrogen stream, cooled in the heat exchanger 121 and passed through a valve 122 into the top of the third column 119. The remainder returns at 28 to the first column as reflux.

The bottom liquid in the first column is rich in oxygen (24 to 26% $O_2$). This first oxygen-enriched liquid, removed at 29, is cooled in exchanger 121 and fed through a valve 123 into the middle of the second column (operated from about 5.0 to 6.5 bara), where it joins with liquid descending in this column. This liquid descends countercurrent to the vapor generated by the bottom reboiler 116.

The vapor ascending in the second column is progressively rectified until a pure nitrogen is achieved on the highest rectification stage. This nitrogen stream is condensed in the top condenser 118 and a portion removed at 31 and passed through valve 125 into the top of the third column 119, while the remainder descends as reflux.

The bottom liquid in the second column is richer yet in oxygen (32-33% of $O_2$), removed at 30 as a second oxygen-enriched liquid, throttled at 124 and fed into the middle of the third column 119 (operated at 3-3.6 bara), where it joins with liquid descending in this column. This liquid descends countercurrent to the vapor generated by bottom reboiler 118.

The vapor ascending in the third column is progressively rectified until a pure nitrogen is achieved on the highest rectification stage. This nitrogen stream is condensed in the top condenser 120 and a portion removed at 32 as a liquid nitrogen product while the remainder descends as reflux.

The bottom liquid in the third column is richer yet in oxygen (50-52% of $O_2$), removed at 33 as a third oxygen-enriched liquid, throttled in 126 to about one atmosphere and transferred to the upper reboiler 120.

A very small amount of the oxygen rich (approximately 78% $O_2$) liquid is removed at 34 from the upper reboiler 120 to guard against build up of a dangerous substances in that reboiler as contaminants.

The vapor exiting the upper reboiler (waste) moves through the sub-cooling heat exchanger 121 and enters at 36 the main heat exchanger 113 where the refrigeration is recovered. At the exit of the main exchanger some of the waste is vented, the rest being used at 38 to regenerate the adsorber 104 associated with water and carbon dioxide removal.

The example stream parameters of the process for producing liquid nitrogen at 88.9 K corresponding to the pressure in the third column 3.27 bara are shown in the Table 1. Using the process with the triple column system allows increasing the liquid nitrogen output (LIN) from 0.33 mol/mol of processed air (p.a.) for the existent process to 0.59 mol/mol p.a. (The processed air flow rate is equal to the feed air flow rate). The increase in liquid nitrogen recovery enables a 20% reduction in the specific power and substantial reduction in the feed air compressor and adsorber size and cost.

The liquid nitrogen product can be subcooled in 127 from the temperature about 86-89 K at 32 to the temperature about 79-81 K at 40 by evaporating a part of liquid nitrogen stream 41 in 128 at reduced pressure close to atmospheric. The evaporating a part of liquid air stream at reduced pressure for the preliminary subcooling can be also used.

Referring to the schematic of FIG. 2, air feed at 10 is filtered in 101, and compressed in 102 to a pressure of 5 to 7.5 bara, cooled in 103 and after removal in adsorber 104 of water and carbon dioxide, the air is mixed with the removed from the main heat exchanger 113 recycle stream 22 and at 13 fed to the compressor 105, where it is further compressed to about 30 bara (+/−5), and cooled in 106.

A portion 16 (or all) of the compressed air stream 14 is then boosted in one or two compressors 107 and 109, driven by one or two turbo expanders 112 and 111, to a pressure between 55 and 75 bara at 18. The other portion 15 of the compressed air is fed in the warm turbo expander 111 and then in the heat exchanger 113 at 17.

The boosted air is then cooled in the heat exchanger 113, and a portion 19 is fed to the cold turbo expander 112, the remainder 23 being further cooled and liquefied, then expanded in a valve 114 and fed in the middle of the first (lower) distillation column 115 as a liquid air stream.

The exhaust 20 from the cold turbo expander is split. One portion returns at 21 to provide cooling in aforementioned heat exchanger 113 while the split remainder 25 is passed through a throttling valve 119, wherein the pressure is decreased by up to 2 bar (for example, from 6.5 to 4.5 bara), and then at 33 fed into the bottom of the first (lower) column as a gaseous air stream.

In that first (lower) column, operated about from 4.5 to 6.5 bara, the air is distilled into pure nitrogen (from 1.0 to 0.0001 mol % of $O_2$) at 26, and condensed in the top condenser 116, a portion of the condensate being removed at 27, as a first liquid nitrogen stream, cooled in the heat exchanger 121 and passed through a valve 122 into the top of the second (upper) column. The remainder returns at 28 to the lower column as reflux.

The bottom liquid in the lower column is rich in oxygen (27 to 28% $O_2$). This first oxygen-enriched liquid removed at 29 is cooled in 121 and fed through a valve 123 into the middle of the upper column (operated from about 2.7 to 3.3 bara), where it joins with liquid descending in this column. This liquid descends countercurrent to the vapor generated by the bottom reboiler 116.

The vapor ascending in the upper column 117 is progressively rectified until a pure nitrogen is achieved on the highest rectification state. This nitrogen stream is condensed in the top condenser 118 and a portion removed at 32 as a liquid nitrogen product while reminder descends as reflux.

The bottom liquid in the upper column is richer yet in oxygen (43-45% of $O_2$), removed at 30 as a second oxygen-enriched liquid throttled in 124 to about one atmosphere and transferred to the upper reboiler 118.

A very small amount of the oxygen rich (approximately 73% $O_2$) liquid is removed at 34 from the upper reboiler to guard against build up of a dangerous substances in that reboiler as contaminants.

The vapor exiting the upper reboiler (waste) moves through the sub-cooling heat exchanger 121 and enters at 36 the main heat exchanger 113 where the refrigeration is recovered. At the exit of the main exchanger some of the waste is vented, the rest being used at 38 to regenerate the adsorber 104 associated with water and carbon dioxide removal.

The example stream parameters of the process for producing liquid nitrogen an 88.1 K corresponding to the pressure 3.05 bara in the upper column are shown in the Table 2. Using the process with the double column system allows increasing the liquid nitrogen output (LIN) from 0.33 mol/mol of processed air (p.a.) for the existent process to 0.52 mol/mol p.a. The increase in liquid nitrogen recovery enables a 15% reduction in the specific power and substantial reduction in the feed air compressor and adsorber size and cost.

The part of the air exhaust from the cold expander is passed into the lower column through a throttling valve using for the expander exhaust pressure control and allowing also to additional increasing the liquid nitrogen recovery. For example, if the pressure in this valve is decreased by 2 bar (from 6.5 to 4.5 bara), the liquid nitrogen output (LIN) is increased by 0.021 mol/mol p.a., that is 3.8% (0.020/0.522=1.038).

The pressure of the liquid nitrogen product can be increased by using a liquid column. For example, if the difference in elevation between the top of the upper column and the place of withdrawal of the liquid nitrogen product is equal to 16 m, the pressure can be increased by 1.2 bar.

As previously noted, the liquid nitrogen product can be subcooled in 127 from the temperature about 86-89 K at 32 to the temperate about 79-81 K at 40 by evaporating a part of the liquid nitrogen stream 41 at reduced pressure close to atmospheric.

The example conditions of the process with the double column system (FIG. 2) for liquid nitrogen production at 81 K are illustrated in the Table 3. In this case the process with the double column system allows increasing the liquid nitrogen output (LIN) from 0.303 mol/mol of processed air (p.a.) for the existent process to 0.448 mol/mol p.a. The increase in liquid nitrogen recovery enables a 12% reduction in the specific power and also substantial reduction in the feed air compressor and adsorber size and cost.

Using the evaporating part of the liquid air stream at reduced pressure for the preliminary subcooling of liquid nitrogen product enables 13% reduction in the specific power as compared with the existent process.

The advantages of the air recycle are lower size (by 33%) of the main heat exchanger as compared with the nitrogen recycle.

The booster compressors 107 and 109 can operate in series as shown in FIG. 2, or in parallel. Series connection reduces the specific power by 1% compared to the parallel.

Feeding the liquid air stream into the lower column allows to increase the LIN output as compared with feeding this stream into the upper column. As is seen from the Table 4, LIN is increased by 4% (0.522/0.502=1.04). In addition, feeding the liquid air stream into the lower column allows reducing of the throttling valve and pipe size.

The liquid air stream fed into the lower column should be equal to at least 40% of the processed air.

The reflux ratio in the columns and correspondingly the number of trays makes a greater impact on the liquid nitrogen product yield and other parameters, that affect the energy and equipment costs. It is estimated that the optimal relationship between the reflux ratio and the minimum reflux ratio for the columns is approximately from 1.1. to 1.2, if the liquid nitrogen product contains about 0.01% of oxygen.

The waste gas removed from the main heat exchanger 113 contains from 38% $O_2$ (Table 3) to 43.4% $O_2$ (Table 2). For the purpose of decreasing the oxygen content in the regeneration gas, one or more trays can be added above the upper reboiler to provide two separate streams: a regeneration gas and a waste stream with increased oxygen content (Table 3).

This method of decreasing the oxygen content in the regeneration gas result in increasing the boiling temperature in the upper reboiler and the pressure in the columns and therefore leads to reducing the liquid nitrogen recovery. Another method in which the pressure in the columns is not increased is discussed below.

Referring to the schematic of FIG. 2*a*, the oxygen-enriched liquid from the upper column is removed at 30, throttled in 124 and transferred to the first upper reboiler 118, wherein this liquid is partially evaporated. The vapor that contains less oxygen is removed at 35, then heated in the exchangers 121 and 113 and used at 38 as a regeneration gas for the adsorber 104. The remainder liquid is removed from 118 at 39, throttled in 125 and fed into the second upper reboiler 120. The vapor exiting 120 at 42 is heated in the exchangers 121 and 113 and vented at 37 as a waste gas.

A very small amount of the oxygen rich (approx 80% $O_2$) liquid is removed at 34 from the second upper reboiler 120 to guard against build up of a dangerous substances in that reboiler as contaminants.

As is seen from the Table 5, the oxygen content in the regeneration gas is equal to 25%, that is much less than in case of using one upper reboiler (43.4% $O_2$), Table 2). The temperature difference in the first upper reboiler is equal to 3.74 K and in the second upper reboiler—1.17 K (Table 5), whereas the temperature difference in the case of using one upper reboiler is equal to 1.20 K (Table 2). The total surface of the first and second upper reboiler is less by 17% than the surface in case of using one upper reboiler.

The part 25 of the air exhaust from the cold expander 112 can be passed into the lower column 115 through an additional expander 119 (FIG. 2*a*) using for the receiving an additional refrigeration capacity. For example, if the pressure is expanded by 2 bar (from 6.5 to 4.5 bara), the additional refrigeration capacity is equal to 2% of the total capacity, and the specific power can be decreased by 1.4% due to reducing the recycle air flow rate. It should be noted that the cold (and warm) expander exhaust pressure decrease is inexpedient, since it leads to a decrease in the efficiency of the recycle system.

ALTERNATIVE ARRANGEMENTS a. The bottoms from the columns can be passed to the upper reboiler;

b. The liquid air stream can be fed to either column;

c. The first and second liquid nitrogen stream or the first liquid nitrogen stream can be used as a liquid nitrogen product;

e. The portions of the liquid nitrogen product removing from the distillation columns are passed through throttling valves into a liquid separator, from which the liquid is removed as a liquid nitrogen product at the temperature about 79-81 K and the vapor is passed through heat exchangers and removed from the process.

TABLE 1

The stream parameters of the process with the triple column system (FIG. 1) for producing liquid nitrogen at 88.9 K (example)

| No | Flow rate, mol/mol p.a.* | Temperature, K. | Pressure, bara | Vapor mole fraction | Content of oxygen, % mol |
|---|---|---|---|---|---|
| 11 | 1.0 | 300.0 | 8.70 | 1.0 | 20.95 |
| 12 | 1.0 | 280.0 | 8.35 | 1.0 | 20.95 |
| 13 | 3.29 | 291.0 | 8.30 | 1.0 | 20.95 |
| 14 | 3.29 | 300.0 | 39.9 | 1.0 | 20.95 |
| 15 | 1.0 | 300.0 | 39.9 | 1.0 | 20.95 |
| 16 | 2.29 | 300.0 | 39.9 | 1.0 | 20.95 |
| 18 | 2.29 | 300.0 | 82.9 | 1.0 | 20.95 |
| 19 | 1.613 | 202.0 | 82.8 | 1.0 | 20.95 |
| 20 | 1.613 | 105.72 | 8.45 | 1.0 | 20.95 |
| 22 | 2.29 | 296.0 | 8.35 | 1.0 | 20.95 |
| 23 | 0.677 | 108.89 | 82.7 | 0.0 | 20.95 |
| 24 | 0.677 | 103.66 | 8.43 | 0.0572 | 20.95 |
| 25 | 0.323 | 105.72 | 8.45 | 1.0 | 20.95 |
| 27 | 0.1641 | 100.96 | 8.30 | 0.0 | 0.01 |
| 29 | 0.8359 | 104.06 | 8.45 | 0.0 | 25.06 |

TABLE 1-continued

The stream parameters of the process with the triple column system (FIG. 1) for producing liquid nitrogen at 88.9 K (example)

| No | Flow rate, mol/mol p.a.* | Temperature, K. | Pressure, bara | Vapor mole fraction | Content of oxygen, % mol |
|---|---|---|---|---|---|
| 30 | 0.6415 | 99.69 | 5.87 | 0.0 | 32.65 |
| 31 | 0.1943 | 95.93 | 5.72 | 0.0 | 0.01 |
| 32 | 0.5896 | 88.91 | 3.27 | 0.0 | 0.01 |
| 33 | 0.4104 | 94.70 | 3.42 | 0.0 | 51.03 |
| 34 | 0.0052 | 87.78 | 1.28 | 0.0 | 78.32 |
| 35 | 0.4052 | 87.78 | 1.28 | 1.0 | 50.68 |

*p.a. — processed air.

TABLE 2

The stream parameters of the process with the double column system (FIG. 2) for producing liquid nitrogen at 88.1 K. (example)

| No | Flow rate, mol/mol p.a.* | Temperature, K. | Pressure, bara | Vapor mole fraction | Content of oxygen, % mol |
|---|---|---|---|---|---|
| 11 | 1.0 | 300.0 | 6.40 | 1.0 | 20.95 |
| 12 | 1.0 | 280.0 | 6.05 | 1.0 | 20.95 |
| 13 | 3.03 | 291.0 | 6.0 | 1.0 | 20.95 |
| 14 | 3.03 | 300.0 | 31.0 | 1.0 | 20.95 |
| 15 | 0.88 | 300.0 | 31.0 | 1.0 | 20.95 |
| 16 | 2.15 | 300.0 | 31.0 | 1.0 | 20.95 |
| 18 | 2.15 | 300.0 | 64.2 | 1.0 | 20.95 |
| 19 | 1.566 | 194.0 | 64.1 | 1.0 | 20.95 |
| 20 | 1.566 | 101.05 | 6.15 | 0.995 | 20.95 |
| 22 | 2.03 | 296.0 | 6.05 | 1.0 | 20.95 |
| 23 | 0.584 | 103.94 | 64.0 | 0.0 | 20.95 |
| 24 | 0.584 | 96.79 | 5.18 | 0.0772 | 20.95 |
| 25 | 0.416 | 101.05 | 6.15 | 0.995 | 20.95 |
| 33 | 0.416 | 98.96 | 5.20 | 0.999 | 20.95 |
| 27 | 0.243 | 94.15 | 5.05 | 0.0 | 0.01 |
| 29 | 0.757 | 97.35 | 5.20 | 0.0 | 27.67 |
| 30 | 0.478 | 92.97 | 3.20 | 0.0 | 43.82 |
| 32 | 0.522 | 88.12 | 3.05 | 0.0 | 0.01 |
| 34 | 0.006 | 86.92 | 1.28 | 0.0 | 73.25 |
| 35 | 0.472 | 86.92 | 1.28 | 1.0 | 43.45 |

*p.a. — processed air.

TABLE 3

The performance of the process with the double column system (FIG. 2) for producing liquid nitrogen at 81 K (example)

| | |
|---|---|
| # of case | 1.2A |
| Recycle | Air |
| Type of scheme | DCU |
| Feed air compressor | |
| flow rate, Nm^3/h | 6920 |
| suction pressure, bara | 0.99 |
| discharge pressure, bara | 6.40 |
| Recycle compressor | |
| flow rate, Nm^3/h | 19151 |
| Nm^3Nm^3 p.a. | 2.7677 |

TABLE 3-continued

The performance of the process with the double column system (FIG. 2) for producing liquid nitrogen at 81 K (example)

| | |
|---|---|
| suction pressure, bara | 6.05 |
| discharge pressure, bara | 31.03 |
| Main exchanger | |
| temperature, K. | |
| middle pressure air inlet | 300 |
| temperature difference, K. | |
| warm end | 3.7 |
| minimum | |
| warm section | 2.5 |
| cold section | 1.6 |
| U*A, kW/K. | 282 |
| 'Warm' expander | |
| inlet pressure, bara | 53.2 |
| outlet pressure, bara | 6.11 |
| inlet temperature, K. | 300 |
| outlet temperature, K. | 177.0 |
| isentropic efficiency | 0.86 |
| flow rate, Nm^3/h | 4860 |
| Nm^3/Nm^3 p.a. | 0.7024 |
| 'Cold' expander | |
| inlet pressure, bara | 49.4 |
| outlet pressure, bara | 6.15 |
| inlet temperature, K. | 177.4 |
| outlet temperature, K. | 101.1 |
| vapor mole fraction | 0.993 |
| isentropic efficiency | 0.88 |
| flow rate, Nm^3/h | 10786 |
| Nm^3/Nm^3 p.a. | 1.5588 |
| Lower column | |
| Pressure, top, bara | 5.95 |
| Vapor flow rate, Nm^3/h | 3415 |
| Concentration | |
| liquid nitrogen, ppm O2 | 3 |
| kettle liquid, % mol O2 | 38.0 |
| Number of theoretical trays | 46 |
| Condenser-reboiler | |
| temperature difference, K. | 2.7 |
| Upper column | |
| Pressure, top, bara | 3.2 |
| Vapor flow rate, Nm^3/h | 3688 |
| Concentration | |
| liquid nitrogen, ppm O2 | 3 |
| kettle liquid, % mol O2 | 46.1 |
| Number of theoretical trays | 40 |
| Condenser-reboiler | |
| temperature difference, K. | 1.5 |
| Liquid Nitrogen product | |
| LIN output, Nm^3/Nm^3 p.a. | 0.448 |
| LIN capacity, Nm^3/h | 3100 |
| Temperature, K. | 81 |
| Pressure, bara | 3.2 |
| Regeneration gas and waste gas | |
| flow rate, Nm^3/Nm^3 p.a. | 0.552 |
| middle concentration, % mol O2 | 37.9 |
| Regeneration gas | |
| flow rate, Nm^3/Nm^3 p.a. | 0.25 |
| concentration, % mol O2 | 21.0 |

TABLE 3-continued

| The performance of the process with the double column system (FIG. 2) for producing liquid nitrogen at 81 K (example) | |
|---|---|
| Waste gas | |
| flow rate, Nm^3/Nm^3 p.a. | 0.302 |
| concentration, % mol O2 | 51.9 |

p.a. — processed air.

TABLE 4

| The performance of the double column system at feeding the liquid air stream into the lower or upper column (example) | | | |
|---|---|---|---|
| # of case | 4.1 | 4.2 | 4.3 |
| Feeding the liquid air stream into | lower column | lower column | lower column |
| Feeding the bottom liquid from the lower column into | upper column | upper column | upper column |
| Liquid air stream, mol/mol p.a. | 0.584 | 0.563 | 0.563 |
| Lower column | | | |
| Pressure (top), bara | 3.05 | 3.05 | 3.05 |
| Concentration, % mol O2 | | | |
| liquid nitrogen | 0.01 | 0.01 | 0.01 |
| kettle liquid | 27.67 | 40.13 | 40.13 |
| LIN output, mol/mol p. a. | 0.243 | 0.2089 | 0.2089 |
| Number of theoretical trays (NTT) | 36 | 36 | 36 |
| section 1 | 32 | 36 | 36 |
| section 2 | 4 | | |
| Upper column | | | |
| Pressure (top), bara | 5.05 | 5.05 | 5.05 |
| Concentration, % mol O2 | | | |
| liquid nitrogen | 0.01 | 0.01 | 0.01 |
| kettle liquid | 43.82 | 42 | 43.8 |
| LIN output, mol/mol p. a. | 0.522 | 0.5013 | 0.5027 |
| Number of theoretical trays (NTT) | 36 | 36 | 36 |
| section 1 | 32 | 30 | 32 |
| section 2 | 4 | 2 | 4 |
| section 3 | | 4 | |

TABLE 5

| The stream parameters of the process in the first and second reboilers (FIG. 2a) (example) | | | | | |
|---|---|---|---|---|---|
| No | Flow rate, mol/mol p.a.* | Temperature, K. | Pressure, bara | Vapor mole fraction | Content of oxygen, % mol |
| 30 | 0.478 | 92.97 | 3.20 | 0.0 | 43.82 |
| 32 | 0.522 | 88.12 | 3.05 | 0.0 | 0.01 |
| 34 | 0.006 | 86.95 | 1.13 | 0.0 | 80.71 |
| 35 | 0.17 | 84.38 | 1.28 | 1.0 | 24.86 |
| 39 | 0.308 | 84.38 | 1.28 | 0.0 | 54.27 |
| 42 | 0.302 | 86.95 | 1.13 | 1.0 | 53.73 |

*p.a. — processed air.

I claim:

1. A method for liquid nitrogen production by cryogenic air separation using a distillation column system, comprising:

a) passing a portion of a pressurized air feed through a cold expander and feeding a part of the pressurized air feed from said expander as a gaseous air stream into a bottom of a high pressure first column having a first reboiler-condenser, wherein the high pressure first column is a two section column;

b) passing another portion of the pressurized air feed through a main heat exchanger for cooling and liquefying, passing said liquefied and cooled another portion of the air feed through a throttling valve for feeding as a liquid air stream into the middle of the high pressure first column;

c) separating the gaseous air stream and the liquid air stream in the high pressure first column into a first gaseous nitrogen stream and a first oxygen-enriched liquid stream;

d) feeding the first oxygen-enriched liquid stream into a middle of a second column having the first reboiler-condenser, in which liquid oxygen in the bottom of the second column is evaporated due to indirect heat exchange with the first gaseous nitrogen stream in the first reboiler-condenser, and a second reboiler-condenser;

e) separating the first oxygen-enriched liquid stream in the second column into a second gaseous nitrogen stream and a second oxygen-enriched liquid stream;

f) feeding the second oxygen-enriched liquid stream into a middle of a third column having the second reboiler-condenser, in which liquid oxygen in the bottom of the third column is evaporated due to indirect heat exchange with the second gaseous nitrogen stream in the second reboiler-condenser, and a third reboiler-condenser;

g) separating the second oxygen-enriched liquid stream in the third column into a third gaseous nitrogen stream and a third oxygen-enriched liquid stream, and feeding the third oxygen-enriched liquid stream into the third reboiler-condenser;

h) evaporating the third oxygen-enriched liquid stream in the third reboiler-condenser due to indirect heat exchange with the third gaseous nitrogen stream in the third reboiler-condenser;

i) removing a first condensed nitrogen stream from the first reboiler-condenser and feeding the first condensed nitrogen stream into the top of the third or second column;

j) removing a second condensed nitrogen stream from the second reboiler-condenser and feeding the second condensed nitrogen stream into the top of the third column or using the second condensed nitrogen stream as a liquid nitrogen product, said product being removed from an upper region of the third column;

k) removing a third condensed nitrogen stream from the third reboiler-condenser and using the third condensed nitrogen stream as the liquid nitrogen product, wherein the liquid level in the third reboiler-condenser is controlled by changing a quantity of the removed liquid nitrogen product;

l) removing the evaporated oxygen-enriched stream from the third reboiler-condenser, warming the evaporated oxygen-enriched stream and removing the warmed evaporated oxygen-enriched stream as waste gas some of which is vented, and the remainder used to regenerate an absorber associated with water and $CO_2$ removed from a first heat exchanger, from which refrigeration is recovered, and further removing a small amount of oxygen rich liquid from the third reboiler-condenser to guard against build-up of contaminants in said third reboiler-condenser;

m) operating the first column at a pressure from 7.5 to 9.0 bara, the second column—from 5.0 to 6.5 bara, the third column—from 3.0 to 3.6 bara;

n) wherein the liquid nitrogen product contains from about 0.0001% to 1% of oxygen and is extracted from one of the first, second, or third reboiler-condensers and then supercooled from a temperature of about 86-89 K to a temperature of about 79-81 K by evaporating a part of the liquid nitrogen product containing from about 0.0001% to 1% of oxygen at reduced pressure close to atmospheric, o) wherein the three columns have serial arrangement whereby oxygen enriched liquid is introduced successively from the first column to the second column and then from the second column to the third column.

2. The method of claim 1 wherein the liquid air stream is fed into the middle of the second or third columns, the first or the second oxygen-enriched liquid streams fed into the third reboiler-condenser.

3. The method of claim 2 wherein the first and the second condensed nitrogen stream, or the first condensed nitrogen stream is used as the liquid nitrogen product characterized as being 99 to 99.99% pure nitrogen gas.

4. The method of claim 1 wherein the pressure in the third reboiler-condenser is close to atmospheric.

5. The method of claim 1 wherein the evaporated part of the liquid nitrogen product containing from about 0.00001% to 1% oxygen at reduced pressure is used for preliminary subcooling of the liquid nitrogen product.

6. The method of claim 1 wherein portions of the liquid nitrogen product removed from the distillation columns are passed through throttling valves into a liquid separator, from which liquid is removed as the liquid nitrogen product at a temperature about 79-81 K and vapor from the separator is passed through heat exchangers and removed from the process.

7. The method of claim 1 wherein the liquid air stream fed into the first column equals at least 40% of the process air.

8. The method of claim 1 wherein one or more trays are optimally added above the third reboiler-condenser to provide two separate streams: a regeneration gas with decreased oxygen content, and waste gas.

9. The method of claim 1 wherein a cleaned and pressurized air feed is mixed with a recycle stream removed from the main heat exchanger and split in two streams, the first stream passed through a warm expander, and the second stream further compressed by using power from the expanders and cooled in the main heat exchanger to become the pressurized air feed previously cooled in the main heat exchanger and split in two portions, a first portion of such air feed being passed through the cold expander and a second portion being further cooled and liquefied in the main heat exchanger, and removing the evaporated oxygen-enriched stream from the third reboiler-condenser, warming the evaporated oxygen-enriched stream and removing the warmed evaporated oxygen-enriched stream from the process as waste gas some of which is vented, and the remainder used to regenerate an absorber associated with water and $CO_2$ removed from the first heat exchanger, from which refrigeration is recovered.

10. The method of claim 1 wherein a cleaned and pressurized air feed is mixed with a recycle stream removed from the main heat exchanger and further compressed by using expanders power, split in two streams, the first stream being passed through a warm expander, the second stream is cooled in the main heat exchanger to become the pressurized air feed and split in two portions, the portion of the air feed passed through the cold expander and the another portion further cooled and liquefied in the main heat exchanger.

11. The method of claim 9 wherein the warm and cold expanders drive booster compressors operating to further compress the second stream, and operate in one of series or parallel.

* * * * *